United States Patent [19]

Matsumura et al.

[11] Patent Number: 5,023,795

[45] Date of Patent: Jun. 11, 1991

[54] FUEL INJECTION CONTROL SYSTEM FOR INTERNAL COMBUSTION ENGINE WITH COMPENSATION OF FUEL AMOUNT CONSUMED FOR WETTING INDUCTION PATH

[75] Inventors: Toshio Matsumura; Yasutoshi Nanyoshi, both of Kanagawa, Japan

[73] Assignee: Nissan Motor Company, Limited, Japan

[21] Appl. No.: 310,870

[22] Filed: Feb. 16, 1989

[30] Foreign Application Priority Data

Feb. 17, 1988 [JP] Japan ..... 63-34391

[51] Int. Cl.[5] ..... F02B 3/02; F02D 4/18; F02M 51/00

[52] U.S. Cl. ..... 364/431.06; 123/478; 123/480; 364/431.05

[58] Field of Search ..... 364/431.04, 431.05, 364/431.06; 123/340, 478, 480, 486, 489, 492, 493

[56] References Cited

U.S. PATENT DOCUMENTS 4,357,923 11/1982 Hideg ..... 123/492
4,388,906 6/1983 Sugiyama et al. ..... 123/492
4,454,847 6/1984 Isomura et al. ..... 123/492
4,481,928 11/1984 Takimoto et al. ..... 123/492
4,667,640 5/1987 Sekozawa et al. ..... 123/492
4,852,538 8/1989 Nagaishi ..... 123/492
4,892,072 1/1990 Miwa et al. ..... 123/340

*Primary Examiner*—Felix D. Gruber
*Attorney, Agent, or Firm*—Lowe,Price, LeBlanc, Becker & Shur

[57] ABSTRACT

A fuel injection control system assumes fuel amount introduced in an engine combustion chamber on the basis of an air/fuel ratio dependent value derived by monitoring an air/fuel ratio dependent component in an exhaust gas, and an intake air amount introduced into the combustion chamber, assumes wetting fuel amount to be consumed for wetting an induction system on the basis of the fuel amount introduced into the combustion chamber and a fuel injection amount injected up to the immediately preceding fuel injection cycle, and prospect fuel amount to be introduced into the combustion chamber on the basis of the current fuel injection amount and the wetting fuel amount. The prospected fuel amount to be introduced into the combustion chamber is compared with a target fuel amount which is derived according to the engine driving condition for modifying the fuel injection amount so that the prospected fuel amount coincides with the target fuel amount.

11 Claims, 5 Drawing Sheets

MRR(k) SETTING
304
MRR(k)
DIVIDER
305
QFR(k)
QAC(k) DERIVATION
301
QAC(k)
REFERENCE DRIVING POINT SETTING
307
QFO
QFCO
QFRO
311
ΔQFR(k)
312
ADDER
313
Δy(k)
X K
314
X N
315
316
ΔQF(k)
317
QF(k)
QFO
TI DERIVATION
318
TI(k)
ENGINE
1
A/F DETECTION
302
MRE(k)
DIVIDER
306
QAC(k-1) DERIVATION
303
QAC(k-1)
QFC(k-1)
QFCO
ΔQFC(k-1)
DERIVATION
308
Δv(k)
X F
310
ΔQFC(k) DERIVATION
309

FUEL INJECTION CONTROL SYSTEM FOR INTERNAL COMBUSTION ENGINE WITH COMPENSATION OF FUEL AMOUNT CONSUMED FOR WETTING INDUCTION PATH

BACKGROUND OF THE INVENTION

1. Field of the Invention

The present invention relates generally to a fuel injection control system for an internal combustion engine. More specifically, the invention relates to a fuel injection control system which can precisely control air/fuel ratio of an air/fuel mixture actually combustioned in a combustion chamber of the engine.

2. Description of the Background Art

In general, fluctuation of air/fuel ratio from a target or stoichiometric value is caused by variation of a fuel amount consumed for wetting intake manifold, intake port and so forth and variation of an amount of fuel suspended in the induction system. The fuel consumed for wetting the intake manifold and intake port will be hereafter referred to as "wetting fuel" and the amount of fuel consumed as wetting fuel will be hereafter referred to as "wetting fuel amount". On the other hand, the fuel suspended in the induction system will be hereafter referred to as "suspending fuel" and the amount of the suspended fuel will be hereafter referred to as "suspending fuel amount". The wetting fuel amount and suspending fuel amount are variable depending upon the engine driving condition. Variations of the wetting and suspending fuel amounts are not linear or stepwise but non-linear fashion. Furthermore, variation of wetting fuel amount and suspending fuel amount is caused with a delay time which is not defined by a given time constant. In addition, the wetting fuel amount and suspending fuel amount vary not only according to the instantaneous engine driving condition but also according to difference between the instantaneous wetting and suspending fuel amount and the wetting and suspending fuel amount in the steady state. Therefore, the dynamic characteristics of a fuel system in the induction system is indeterminate since part of the injected fuel may be consumed as wetting fuel and part of the fuel on the periphery of the induction system is vaporized to be introduced into the combustion cylinder with the injected fuel. Therefore, it is difficult or impossible to precisely control the air/fuel ratio at the stoichiometric value.

Japanese Patent First (unexamined) Publication (Tokkai) Showa No. 60-166731 discloses a fuel injection control system. In the disclosed system, the wetting fuel amount is assumed or calculated, (hereinafter prospected), on the basis of transition period of oxygen concentration indicative signal produced by an oxygen sensor provided in an exhaust system, which transition period varies according to engine speed. The fuel injection amount is controlled on the basis of the assumed or prospected wetting fuel amount so as to maintain the air/fuel ratio near the stoichiometric value for anti-polution purpose.

When FEEDBACK control of the air/fuel ratio is performed for controlling fuel injection amount, on the basis of the oxygen concentration indicative signal of the oxygen sensor in an engine which has relatively large quantities of wetting fuel amount and fuel vaporization amount, hunting in fuel injection amount control can occur, thus worsening the air/fuel ratio worse.

SUMMARY OF THE INVENTION

Therefore, it is an object of the present invention to provide a fuel injection control system which can control air/fuel ratio of an air/fuel mixture in an engine combustion chamber.

Another object of the invention is to provide a fuel injection control system which can avoid delay of response in the fuel injection control with respect to the engine driving condition.

In order to accomplish aforementioned and other objects, a fuel injection control system, according to the present invention, assumes fuel amount introduced in an engine combustion chamber on the basis of an air/fuel ratio dependent value derived by monitoring an air/fuel ratio dependent component in an exhaust gas, and an intake air amount introduced into the combustion chamber, assumes wetting fuel amount to be consumed for wetting an induction system on the basis of the fuel amount introduced into the combustion chamber and a fuel injection amount injected up to the immediately preceding fuel injection cycle, and prospects a fuel amount to be introduced into the combustion chamber on the basis of the current fuel injection amount and the wetting fuel amount. The prospected fuel amount to be introduced into the combustion chamber is compared with a target fuel amount which is derived according to the engine driving condition for modifying the fuel injection amount so that the prospected fuel amount coincides with the target fuel amount.

According to one aspect of the invention, a fuel injection control system for an internal combustion engine, comprises:

sensor means for monitoring an engine driving condition including an intake air flow rate in an induction system of the internal combustion engine and an air/fuel ratio of actually combustioned air/fuel mixture in a combustion chamber of the engine for providing a fuel injection control parameter signal;

first means responsive to the fuel injection control parameter signal for setting a target air/fuel ratio of an air/fuel mixture to be actually introduced into the combustion chamber of the internal combustion engine on the basis of the an air/fuel ratio control parameter represented by the fuel injection control parameter signal and deriving a target fuel amount necessary for establishing the target air/fuel ratio;

second means for deriving an amount of intake air introduced into the combustion chamber on the basis of a intake air flow rate indicative parameter data;

third means for arithmetically deriving a fuel amount wetting the periphery of the induction system on the basis of the introduced intake air amount and an air/fuel ratio indicative parameter data representative of air/fuel ratio of the actually combustioned air/fuel mixture;

fourth means for deriving a basic fuel injection amount on the basis of basic fuel injection control parameters represented by the fuel injection control parameter signal;

fifth means for arithmetically deriving a fuel amount to be introduced into the combustion chamber on the basis of the basic fuel injection amount and the fuel amount wetting the periphery of the induction system; and sixth means for comparing the fuel amount to be introduced into the combustion chamber with the target fuel amount for modifying the basic fuel injection amount so that a difference between the fuel amount to be introduced into combustion chamber and the target fuel amount is reduced to zero and outputting a fuel injection control signal representative of the modified fuel injection amount.

The sensor means may include an oxygen sensor disposed in an exhaust system of the internal combustion engine for monitoring oxygen concentration as a parameter data of the air/fuel ratio of the actually combustioned air/fuel mixture. The target air/fuel mixture ratio may be variable depending upon the engine driving condition. Practically, the first means differentiates the target air/fuel ratio between an engine steady state and an engine transition state.

According to another aspect of the invention, an air/fuel ratio control system for an internal combustion engine, comprises:

sensor means for monitoring an engine driving condition including an intake air flow rate in an induction system of the internal combustion engine and an air/fuel ratio of actually combustioned air/fuel mixture in a combustion chamber of the engine for providing various fuel injection control parameter data including a first fuel injection control parameter data representative of a basic fuel injection control parameter including an intake air flow rate indicative component, a second fuel injection control parameter data representative of the air/fuel ratio of the actually combustioned air/fuel mixture;

first means detective of engine driving condition based on the input from the sensor means, for setting a target air/fuel ratio of an air/fuel mixture to be actually introduced into the combustion chamber of the internal combustion engine on the basis of the an air/fuel ratio control parameter represented by the fuel injection control parameter signal and deriving a target fuel amount necessary for establishing the target air/fuel ratio;

second means for deriving an amount of intake air introduced into the combustion chamber on the basis of a intake air flow rate indicative component of the first fuel injection control parameter data;

third means for arithmetically deriving a fuel amount wetting the periphery of the induction system on the basis of the introduced intake air amount and the second fuel injection control parameter data;

fourth means for deriving a basic fuel injection amount on the basis of the first fuel injection control parameter data;

fifth means for arithmetically deriving a fuel amount to be introduced into the combustion chamber on the basis of the basic fuel injection amount and the fuel amount wetting the periphery of the induction system; and sixth means for comparing the fuel amount to be introduced into the combustion chamber with the target fuel amount for modifying the basic fuel injection amount so that a difference between the fuel amount to be introduced into combustion chamber and the target fuel amount is reduced to zero and outputting a fuel injection control signal representative of the modified fuel injection amount.

The second means may derive the introduced air amount based on the intake air flow rate indicative component and an intake air temperature indicative data monitored by the sensor means. The sensor means includes an intake air pressure sensor for monitoring an intake air pressure to produce an intake air pressure indicative data for serving as the intake air flow rate indicative component.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
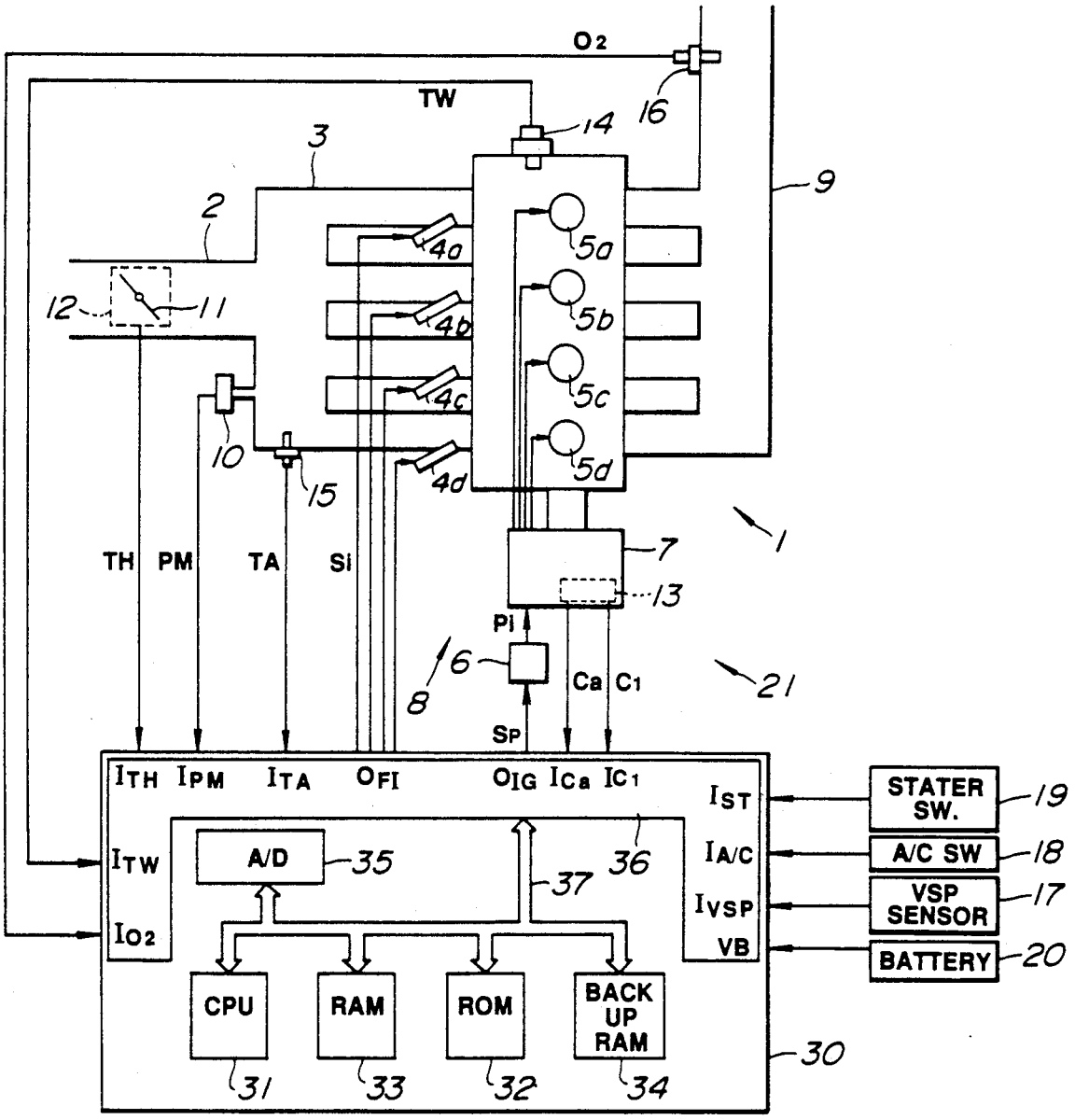
FIG. 1 is a schematic diagram showing overall construction of the preferred embodiment of a fuel injection control system according to the present invention.

Referring now to the drawings, particularly to FIG. 1, the preferred embodiment of a fuel injection control system, according to the present invention, will be discussed herebelow in terms of that applied for a 4-cylinder fuel injection internal combustion engine 1. The engine 1 has an induction system 2 which includes an intake manifold 3 which has four branches respectively connected to corresponding engine cylinders. Into respective branches of the intake manifold 3, fuel injection valve 4*a*, 4*b*, 4*c* and 4*d* are inserted for injecting fuel for forming an air/fuel mixture to be introduced into respectively associated engine cylinders. The fuel injection valves 4*a*, 4*b*, 4*c* and 4*d* are controlled by fuel injection signal Si.

Spark ignition plugs 5*a*, 5*b*, 5*c* and 5*d* are provided for respective engine cylinders for performing combustion in respective combustion chambers. The spark ignition plugs 5*a*, 5*b*, 5*c* and 5*d* are driven by spark ignition pulse Pi generated by an ignitor 6 and distributed through a distributor 7. The trigger timing of ignitor 6 is controlled by a spark ignition control signal Sp. A crank angle sensor 13 is incorporated in the distributor 7 so as to monitor angular position of a rotor of the distributor, which rotor rotates in synchronism with the engine revolution cycle. The ignition plugs 5*a*, 5*b*, 5*c* and 5*d*, the ignitor 6 and the distributor 7 forms a spark ignition system 8. The crank angle sensor 13 produces a crank reference signal Ca at every predetermined angular position, i.e. 70° before top-dead-center (BTDC) of respective engine cylinder, and a crank position signal $C_1$ at every given angular displacement, e.g. 2°.

Each combustion chamber of the engine 1 is connected to an exhaust manifold of an exhaust passage 9. A catalyst converter (not shown) is provided in the exhaust passage for removing polutant components, such as CO, HC, $No_x$ in the exhaust gas and thereby for purification of the exhaust gas for anti-polution purpose.

A throttle valve 11 is provided in the induction system 2 for controlling intake air flow rate. The throttle valve 11 is associated with a throttle angle sensor 12 for monitoring angular position of the throttle valve to produce a throttle angle indicative signal TH representative of the throttle valve angular position. An intake air pressure sensor 10 is provided in the intake manifold 3 for monitoring the pressure of the intake air and produces an intake air pressure indicative signal PM.

The intake air pressure sensor 10, the throttle angle sensor 12 and the crank angle sensor 13 are connected to a control unit 30. The control unit 30 has an input port $I_{PM}$ connected to the intake air pressure sensor to receive the intake air pressure indicative signal PM therethrough. An intake port $I_{TH}$ is provided for connecting the control unit 30 to the throttle angle sensor 12 to receive therefrom the throttle angle indicative signal TH. Intake ports $I_{Ca}$ and $I_{C1}$ are connected to the crank angle sensor 13 to receive therefrom the crank reference signal Ca and the crank position signal $C_1$. The control unit 30 has output ports $O_{FI}$ connected to the fuel injection valves 4a, 4b, 4c and 4d for supplying the fuel injection signals Si for controlling fuel injection timing and fuel injection amount. The control unit 30 is further provided with an output port $O_{IG}$ connected to the ignitor 6 for supplying the spark ignition control signal Sp to control spark ignition timing.

In addition, the control unit 30 is connected to an engine coolant temperature sensor 14, an intake air temperature sensor 15, an oxygen sensor 16, a vehicle speed sensor 17, an air conditioner switch 18, a starter switch 19 and a vehicular battery 20 as a power source through respective input ports $I_{Tw}$, $I_{TA}$, $I_{O2}$, $I_{VSP}$, $I_{A/C}$, $I_{ST}$ and a power input terminal VB.

The engine coolant temperature sensor 14 is inserted in a water jacket defined in the engine block to monitor an engine coolant temperature. The engine coolant temperature sensor 14 produces an engine coolant temperature indicative signal Tw. The intake air temperature sensor 15 is provided in the intake manifold 3 for monitoring the intake air temperature flowing through the intake manifold to produce an intake air temperature indicative signal TA. The oxygen sensor 16 is disposed in the exhaust passage 9 to monitor oxygen concentration in the exhaust gas flowing through the exhaust passage and whereby monitoring the air/fuel ratio in the exhaust gas flowing through the exhaust system. The oxygen sensor 16 produces an oxygen concentration indicative signal $O_2$. The vehicle speed sensor 17 monitors vehicle speed to produce a vehicle speed indicative signal VSP. The air conditioner switch 18 is connected to the control unit 30 to feed HIGH level air conditioner active state indicative signal while an air conditioner switch is held ON. The starter switch 19 is responsive to turning an ignition switch at the starter position to feed HIGH level engine cranking condition indicative signal.

The control unit 30 comprises an input/output unit 36 having the aforementioned input and output ports $I_{PM}$, $I_{TH}$, $I_{Ca}$, $I_{Cl}$, $I_{VSP}$, $I_{A/C}$, $I_{ST}$, $I_{Tw}$, $I_{O2}$, $O_{FI}$, $O_{IG}$ and so forth. The control unit 30 also has CPU 31, ROM 32, RAM 33, back-up RAM 34 and an analog-to-digital (A/D) converter 35. The input/output unit 36, CPU 31, ROM 32, RAM 33, back-up RAM 34 and A/D converter 35 are connected to each other by data bus 37. CPU 31 performs fuel injection and spark ingition control operation according to programs stored in ROM 32. The back-up RAM 34 comprises a non-volatile memory for maintaining stored data even when the power supply is turned OFF.

Figure 2:
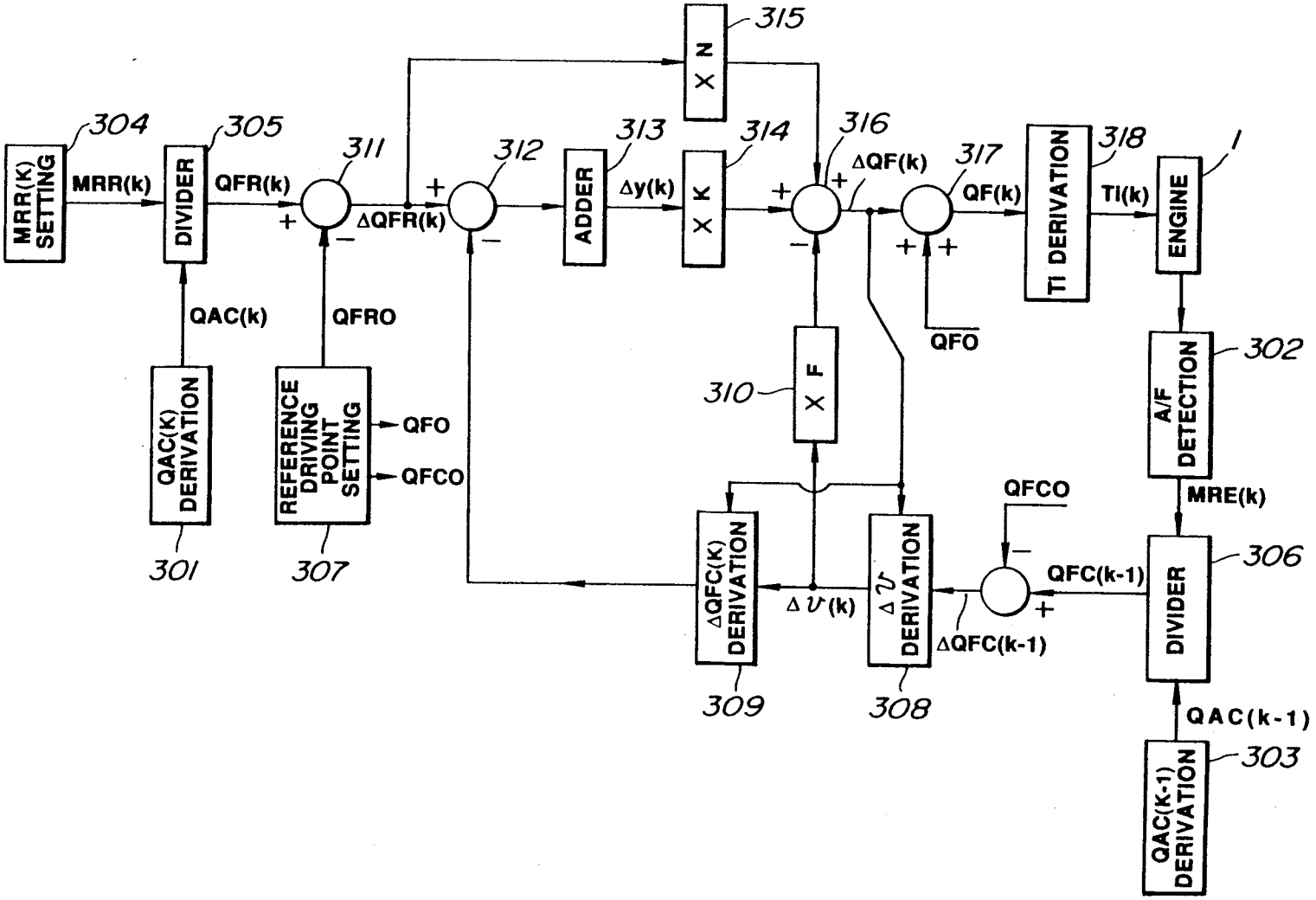
FIG. 2 is a discrete form block diagram of the preferred embodiment of the fuel injection system of FIG. 1.

FIG. 2 shows a block diagram showing the control unit 30 in a operational discrete form. Operation in each block in the circuit shown in FIG. 2 will be discussed in the discussion of a process of fuel injection control which will be given herebelow with reference to FIGS. 4 to 6.

Figure 4:
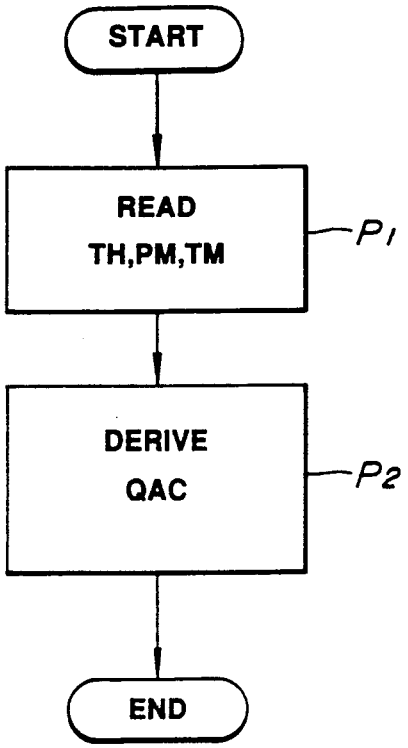
FIG. 4 is a flowchart showing a routine for deriving intake air amount introduced into an engine combustion chamber.

FIG. 4 shows a flowchart showing a process of calculating the intake air amount QAC introduced into the engine cylinder. The shown routine is executed as an interrupt routine which is executed at a given interval interrupting a main routine executed as background job and governing various routines.

Immediately after starting execution, the throttle angular position indicative signal TH input through the input port $I_{TH}$, the intake air pressure indicative signal PM input through the input port $I_{PM}$ and the intake air temperature indicative signal TA input through the input port $I_{TA}$ are read out at a step P1. The throttle angular position indicative signal TH, the intake air pressure indicative signal PM and the intake air temperature indicative signal TA are input in analog form. Therefore, A/D converter 35 converts the input signals to establish digital form throttle angle data, the intake air pressure data and the intake air temperature data. Based on the throttle angle data TH, the intake air pressure data PM and the intake air temperature data TA, the intake air amount QAC to be introduced into the engine cylinder is arithmetically derived at a step P2.

A process of derivation of the intake air amount QAC to be introduced into the engine cylinder has been disclosed in the Japanese Patent First (unexamined) Publication No. 62-206241. In the alternative, the technology for arithmetically deriving the intake air amount may be that disclosed in the U.S. patent application Ser. No. 195,975, filed on May 19, 1988, and now U.S. Pat. No. 4,892,072, and assigned to the common assignee to the present invention. The disclosures of the above-identified Japanese Patent First Publication and the United States Patent Application will be herein incorporated by reference for the sake of disclosure.

The process illustrated in FIG. 4 corresponds to the function block 301 in FIG. 2.

Figure 3:
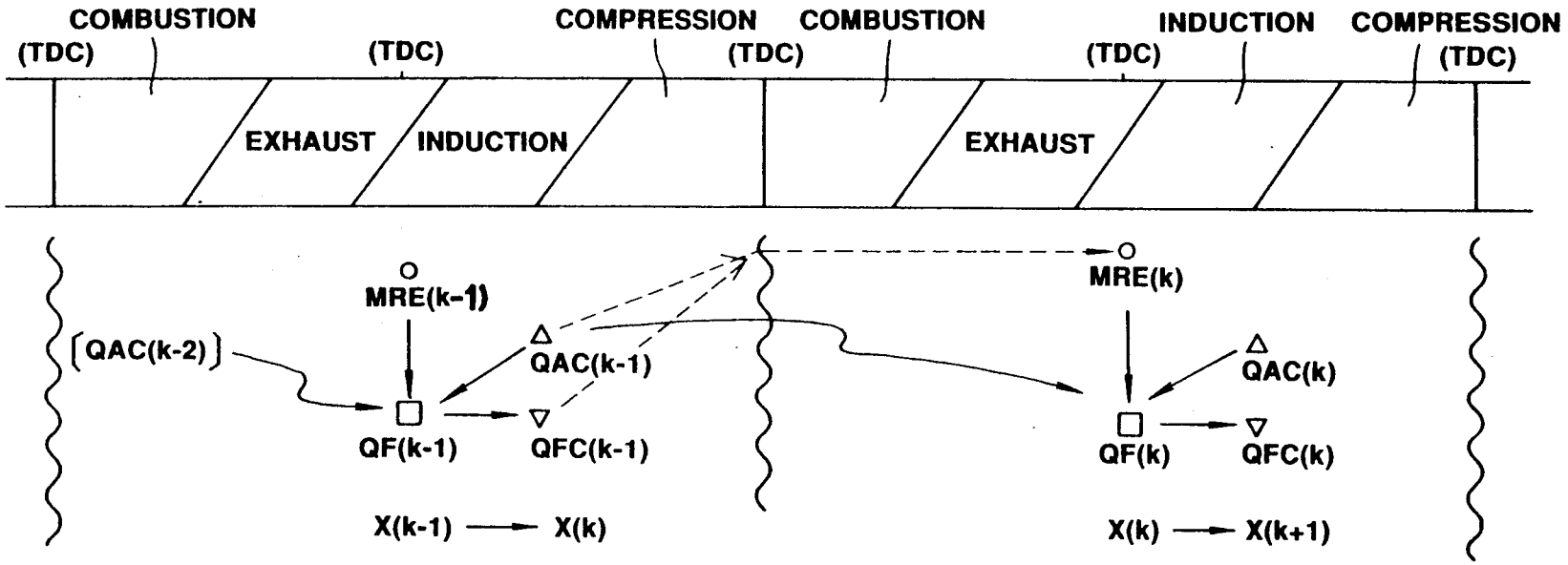
FIG. 3 is a chart showing variation of fuel injection control parameters according to engine revolution cycle.
Figure 5:
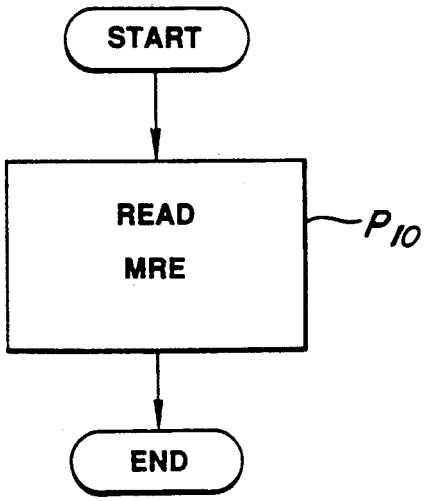
FIG. 5 is a flowchart showing a routine for deriving an air/fuel ratio in an exhaust system.

FIG. 5 shows the process to derive the air/fuel ratio in the exhaust system. Similarly to the routine of FIG. 4, the shown routine is executed at every given timing interrupting the background job. The shown routine is constituted by a single step P10 in which an air/fuel ratio MRE(k) in the exhaust gas flowing through the exhaust system is arithmetically derived on the basis of the oxygen concentration indicative signal $O_2$. The air/fuel ratio MRE(k) in the exhaust system will be hereafter referred to as "exhaust air/fuel ratio". The trigger timing of the routine of FIG. 5 is determined in synchronism with the engine revolution cycle so that the shown routine is triggered at an exhaust cycle for exhausting exhaust gas created in the immediately preceding combustion cycle. Delay of trigger timing of the shown routine from the timing, at which the exhaust valve starts, is determined depending upon the engine speed, the intake air flow rate and length of path through which the exhaust gas reaches the position of the oxygen sensor 16. The timing of reading the oxygen concentration indicative signal $O_2$ in relation to the engine revolution cycle is as illustrated in FIG. 3.

This process in FIG. 5 corresponds to the process to be performed in the function block 302.

Figure 6:
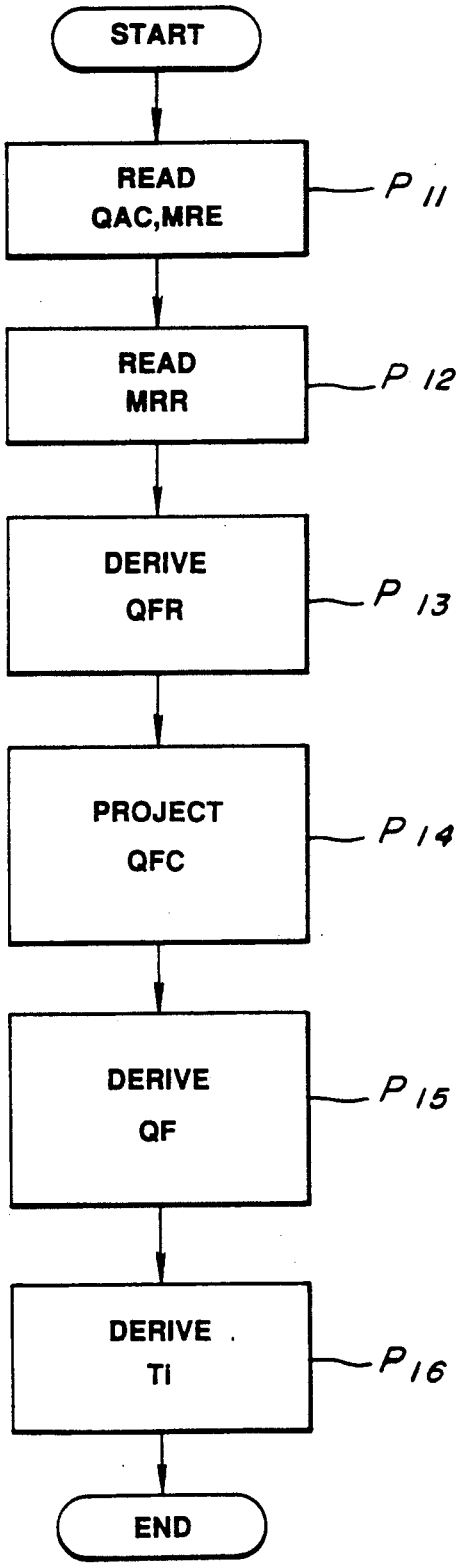
FIG. 6 is a flowchart showing a routine for fuel injection pulse.

The process illustrated in FIG. 6 is triggered by every crank reference signals Ca. Therefore, in the shown embodiment, the shown process is performed every 180° of engine revolution.

Immediately after starting execution, the intake air amounts QAC(k−1) introduced into the combustion chamber derived through the the process in FIG. 4, the intake air amount QAC(k) to be introduced into the combustion chamber, and the exhaust air/fuel ratio MRE(k) derived through the process in FIG. 5, are read out, at a step P11. At a step P12, a target air/fuel mixture ratio MRR(k) is derived and read out. The intake air amount QAC(k) is a prospected value rather than actually measured value derived through the process of FIG. 4. The prospected intake air amount can be derived on the basis of the throttle angle indicative data, the intake air pressure, the intake air temperature and so forth. The process of deriving the prospected intake air amount has also been disclosed in the above identified U.S. patent application Ser. No. 195,975. In the alternative, the prospected intake air amount can be derived according to the process disclosed in the aforementioned Japanese Patent First Publication No. 62-206241 as set forth above. The intake air amount QAC(k−1) may be the intake air amount in the immediately preceding execution cycle of the routine of FIG. 4. In the alternative, it may be possible to use the actually monitored value as the introduced intake air amount QAC(k−1). In the discrete circuit of FIG. 2, the derivation of the introduced intake air amount QAC(k−1) is performed in the function block of 303.

The target air/fuel mixture ratio MRR(k) may be set in a form of a table to be read in terms of preselected engine driving condition indicative parameters. The target air/fuel mixture ratio MRR(k) may be variable, depending upon the steady state and transition state of the engine driving condition. The process in the step P12 of FIG. 6 corresponds to the process to be performed in the function block 304 in FIG. 2.

At a step P13, a target fuel amount QFR(k) is derived on the basis of the prospected intake air amount QAC(k) and the target air/fuel mixture ratio MRR(k). The target fuel amount QFR(k) may be derived from the following equation:

$$QFR(k)=QAC(k)/MRR(k) \tag{1}$$

The process in the step P13 corresponds to the process performed in the function block 305 of FIG. 2.

Then, at a step P14, the fuel amount QFC(k−1) introduced into the combustion chamber is derived on the basis of the introduced intake air amount QAC(k−1) and the exhaust air/fuel ratio MRE(k). Practically, the introduced fuel amount QFC(k−1) can be derived from the following equation:

$$QFC(k-1)=QAC(k-1)/MRE(k) \tag{2}$$

where it should be noted that the exhaust air/fuel ratio MRE(k) represents the air/fuel ratio in the exhaust gas created in the immediately preceding combustion. The process in the step P14 may correspond to the process in the function block 306 in FIG. 2. Based on the introduced fuel amount QFC(k−1) and a fuel injection amount QF(k−1) in the immediately preceding injection timing, a wetting fuel amount x(k) is projected.

At a step P15, a fuel amount QFC(k) to be introduced into the combustion chamber in the current induction cycle is projected based on the aforementioned projected wetting fuel amount x(k) and the fuel injection amount QF(k) for the current fuel injection. At the step P15, the fuel injection amount QF(k) is modified so that the fuel amount QFC(k) to be introduced into the combustion chamber coincides with the target fuel amount QFR(k). The process in the step P15 corresponds to the process done in the function blocks 316 and 317 in FIG. 2.

At a step P16, a fuel injection pulse width Ti(k) is derived in view of the construction of the engine, type and configuration of the fuel injection valves 4*a*, 4*b*, 4*c* and 4*d*, and fuel pressure applied to the fuel injection valves. In practice, the fuel injection pulse width Ti(k) is derived by the following equations:

$$Ti=TE(k)+TS(k) \tag{3}$$

$$TE(k)=l_1\times QF(k)+l_2$$

$$TS(k)=l_3\times VB+l_4 \tag{4}$$

where $l_1$ to $l_4$ are constant; and

VB is a battery voltage.

The process done in the step P16 corresponds to the process performed in a function block 318 in the discrete circuit of FIG. 2.

Here, the manner of projecting the wetting fuel amount x(k) and the projected fuel amount QFC(k) will be discussed. Assuming respective variation of values from a certain driving condition as a reference driving condition is represented by the values accompanying Δ, the fuel transfer characteristics from the fuel injection valve to the oxygen sensor can be described including effects of delay of fuel to be introduced into the engine cylinder by wetting of periphery of the induction system, and delay in detection of the oxygen concentration by the oxygen sensor. The setting of the reference driving condition may be done in a function block 307 in the discrete circuit in FIG. 2. This transfer characteristics may be illustrated by:

$$\Delta QFC(k-1)=\beta\times\Delta x(k-1)+\alpha\times\Delta QF(k-1)$$

$$\Delta x(k)=(1-\beta)\times\Delta x(k-1)+(1-\alpha)\times\Delta QF(k-1) \tag{5}$$

$$\Delta QFC(k)=\beta\times\Delta x(k)+\alpha\times\Delta QF(k)$$

$$\Delta x(k+1)=(1-\beta)\times\Delta x(k)+(1-\alpha)\times\Delta QF(k) \tag{6}$$

Here, as shown in FIG. 3, by utilizing ΔQFC(k−1) and ΔQF(k−1), the projected value Δv(k) of the projected wetting fuel amount Δx(k) can be obtained from the following equation:

$$\Delta w(k+1)=(1-\beta-\beta l)\times\Delta w(k)+[(1-\beta)l-\beta l^2]\times\Delta QFC(k-1)+(1-A-\beta l)\times QFC(k)$$

$$\Delta v(k)=\Delta w(k)+l\times\Delta QFC(k-1) \tag{7}$$

where

Δw is auxiliary variable;

l is constant ($|1-\beta-\beta l|<1$)

When $1-\beta=\beta l$ in the equation (7) set forth above, the equation (7) can be modified as follows:

$$\Delta w(k+1)-[1-\alpha-\{(1-\beta)/\beta\}\alpha]\times\Delta QF(k)=(1-\alpha/\beta)\times\Delta QF(k) \tag{8}$$

$$\Delta v(k)=(1-\alpha/\beta)\times\Delta QF(k-1)+\{(1-\beta)/\beta\}\times\Delta QFC(k-1) \quad (9)$$

The operation for deriving the wetting fuel amount Δv is done by a block 308 in the discrete circuit of FIG. 2.

On the other hand, the projected fuel amount ΔQFC(k) can be derived from the following equation:

$$\Delta QFC(k)=\beta\times\Delta v(k)+\alpha\times\Delta QF(k) \quad (10)$$

The process to derive the projected fuel amount ΔQFC(k) corresponds to the process done in the function block 309 in the discrete circuit of FIG. 2. From the projected fuel amount ΔQFC(k) derived as above, the fuel injection amount QF(k) can be described as a magnitude of variation ΔQF(k) by the following equation:

$$\Delta QF(k)=-F\times\Delta v(k)+K\times\Delta y(k)+N\times\Delta QFR(k)$$

$$\Delta y(k+1)=\Delta y(k)+[\Delta QFR(k)-\Delta QFC(k)] \quad (11)$$

Δy is an auxiliary variable, which corresponds to an integrated value of (ΔQFR(k)−ΔQFC(k)), and F, K, N are parameters satisfying the following conditions.

(1) while performing control, a CLOSE or FEEDBACK loop can be held stable; and (2) the value approaches the target value as $k\rightarrow\infty$, and ΔQFC coincides with ΔQFR.

The arithmetic operation for calculating the aforementioned equation (11) is done by the function blocks 310 through 315.

Here, assuming the characteristic value of the FEEDBACK system is zero, the following equations can be established:

$$F=(2\beta-\beta^2-\alpha)/[\beta(1-\alpha)]$$

$$K=1/\beta \quad (12)$$

Assuming the final value of the auxiliary variable Δy is Δy*, the following equation can be established:

$$N=\{(2-\Delta y^*)\beta-\alpha\}/\beta^2 \text{(N can be zero)} \quad (13)$$

When Δy* is zero, the equation (13) can be modified as:

$$N=(2\beta-\alpha)/\beta^2$$

where $QF(k)=QF0+\Delta QF(k)$ $\Delta QFR(k)=QFR(k)-QFR0$

QF0 and QFR0 represent initial values of QF and QFR.

As will be appreciated herefrom, according to the present invention, the fuel amount introduced into the combustion chamber can be arithmetically derived on the basis of the exhaust air/fuel ratio, and fuel injection control is performed so as to control the fuel amount to be introduced into the combustion chamber to become equal to the target fuel amount. This successfully avoids the influence in the delay of fuel transferring system. Therefore, the air/fuel ratio of the air/fuel mixture to be introduced into the combustion chamber can be controlled precisely for achieving better anti-polution performance.

Furthermore, since the transfer characteristics representative parameters α and β are variable depending upon the reference driving condition as the selected initial condition, by appropriately setting α and β according to the engine driving condition, air/fuel ratio control becomes possible at all engine driving range and condition.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

For example, though the shown embodiment derives the intake air flow rate by intake air pressure and/or the throttle valve angular position, it is of course possible to directly measure the intake air flow rate by means of an air flow meter.

What is claimed is:

1. A fuel injection control system for an internal combustion engine, comprising:

sensor means for monitoring an engine driving condition including an intake air flow rate in an induction system of the internal combustion engine and an air/fuel ratio of actually combustioned air/fuel mixture in a combustion chamber of said engine for providing a fuel injection control parameter signal;

control means including a first arithmetic stage responsive to said fuel injection control parameter signal for setting a target air/fuel ratio of an air/fuel mixture to be actually introduced into said combustion chamber of said internal combustion engine on the basis of an air/fuel ratio control parameter represented by said fuel injection control parameter signal and deriving a target fuel amount necessary for establishing said target air/fuel ratio;

a second arithmetic stage for deriving an amount of intake air introduced into said combustion chamber on the basis of an intake air flow rate indicative parameter data;

a third arithmetic stage for arithmetically deriving a fuel amount wetting the periphery of said induction system on the basis of said introduced intake air amount and an air/fuel ratio indicative parameter data representative of air/fuel ratio of said actually combustioned air/fuel mixture;

a fourth arithmetic stage for deriving a basic fuel injection amount on the basis of basic fuel injection control parameters represented by said fuel injection control parameter signal;

a fifth arithmetic stage for arithmetically deriving a fuel amount to be introduced into said combustion chamer on the basis of said basis fuel injection amount and said fuel amount wetting the periphery of said induction system; and a sixth arithmetic stage for comparing said fuel amount to be introduced into said combustion chamber with said target fuel amount for modifying said basic fuel injection amount so that a difference between said fuel amount to be introduced into said combustion chamber and said target fuel amount is reduced to zero and outputting a fuel injection control signal representative of the modified fuel injection amount.

2. A fuel injection control system as set forth in claim 1, wherein said sensor means includes an oxygen sensor disposed in an exhaust system of said internal combustion engine for monitoring oxygen concentration as a parameter data of said air/fuel ratio of said actually combustioned air/fuel mixture.

3. A fuel injection control system as set forth in claim 1, wherein said target air/fuel ratio is variable depending upon the engine driving condition.

4. A fuel injection control system as set forth in claim 3, wherein said first arithmetic stage differentiates said target air/fuel ratio between an engine steady state and an engine transition state.

5. An air/fuel ratio control system for an internal combustion engine, comprising:

sensor means for monitoring an engine driving condition including an intake air flow rate in an induction system of the internal combustion engine and an air/fuel ratio of actually combustioned air/fuel mixture in a combustion chamber of the engine for providing various fuel injection control parameter data including a first fuel injecton control parameter data representative of a basic fuel injection control parameter including an intake air flow rate indicative component, a second fuel injection control parameter data representative of said air/fuel ratio of said actually combustioned air/fuel mixture;

control means including:

first arithmetic means detective of engine driving condition based on an input from the sensor means, for setting a target air/fuel ratio of an air/fuel mixture to be actually introduced into the combustion chamber of the internal combustion engine on the basis of an air/fuel ratio control parameter represented by said fuel injection control parameter data and deriving a target fuel amount necessary for establishing said target air/fuel ratio;

second arithmetic means for deriving an amount of intake air introduced into the combustion chamber on the basis of an intake air flow rate indicative component of said first fuel injection control parameter data;

third arithmetic means for arithmetically deriving a fuel amount wetting a periphery of the induction system on the basis of said introduced intake air amount and said second fuel injection conrol parameter data;

fourth arithmetic means for deriving a basic fuel injection amount on the basis of said first fuel injection control parameter data;

fifth arithmetic means for arithmetically deriving a fuel amount to be introduced into the combustion chamber on the basis of said basis fuel injection amount and said fuel amount wetting the periphery of the induction system; and sixth arithmetic means for comparing said fuel amount to be introduced into the combustion chamber with said target fuel amount for modifying said basic fuel injection amount so that a difference between said fuel amount to be introduced into the combustion chamber and said target fuel amount is reduced to zero and for outputting a fuel injection control signal representative of the modified fuel injection amount.

6. An air/fuel ratio control system as set forth in claim 5, wherein said second arithmetic means derives said introduced intake air amount based on said intake air flow rate indicative component and an intake air temperature indicative data monitored by said sensor means.

7. An air/fuel ratio control system as set forth in claim 6, wherein said sensor means includes an intake air pressure sensor for monitoring an intake air pressure to produce an intake air pressure indicative data for serving as said intake air flow rate indicative component.

8. An air/fuel ratio control system as set forth in claim 7, wherein said sensor means includes an oxygen sensor disposed in an exhaust system of the internal combustion engine for monitoring oxygen concentration as a parameter data of said air/fuel ratio of said actually combustioned air/fuel mixture.

9. An air/fuel ratio control system as set forth in claim 8, wherein said target air/fuel mixture ratio is variable depending upon the engine driving condition.

10. An air/fuel ratio control system as set forth in claim 9, wherein said first arithmetic means differentiates said target air/fuel ratio between an engine steady state and an engine transition state.

11. In an internal combustion engine including sensor means for monitoring an engine driving condition including an intake air flow rate in an induction system of the internal combustion engine and an air/fuel ratio of actually combustioned air/fuel mixture in a combustion chamber of the engine for providing various fuel injection control parameter data including a first fuel injection control parameter data representative of a basic fuel injection control parameter including an intake air flow rate indicative component and a second fuel injection control parameter data representative of said air/fuel ratio of said actually combustioned air/fuel mixture, a method for controlling an air-fuel ratio comprising the steps of:

setting a target air/fuel ratio of an air/fuel mixture to be actually introduced into the combustion chamber of the internal combustion engine on the basis of an air/fuel ratio control parameter represented by said fuel injection control parameter data and deriving a target fuel amount necessary for establishing said target air/fuel ratio;

deriving an amount of intake air introduced into the combustion chamber on the basis of an intake air flow rate indicative component of said first fuel injection control parameter data; arithmetically deriving a fuel amount wetting a periphery of the induction system on the basis of said introduced intake air amount and said second fuel injection control parameter data;

deriving a basic fuel injection amount on the basis of said first fuel injection control parameter data;

arithmetically deriving a fuel amount to be introduced into the combustion chamber on the basis of said basic fuel injection amount and said fuel amount wetting the periphery of the induction system; and comparing said fuel amount to be introduced into the combustion chamber with said target fuel amount for modifying said basic fuel injection amount so that a difference between said fuel amount to be introduced into the combustion chamber and said target fuel amount is reduced to zero and outputting a fuel injection control signal representative of the modified fuel injection amount.

* * * * *